US009555307B1

(12) United States Patent
Lewis et al.

(10) Patent No.: US 9,555,307 B1
(45) Date of Patent: Jan. 31, 2017

(54) CONTINUOUS BALL FEED AND STROKE PRACTICE DEVICE

(71) Applicants: Norman Drake Lewis, La Honda, CA (US); Waldon Lewis, Capitola, CA (US)

(72) Inventors: Norman Drake Lewis, La Honda, CA (US); Waldon Lewis, Capitola, CA (US)

( * ) Notice: Subject to any disclaimer, the term of this patent is extended or adjusted under 35 U.S.C. 154(b) by 0 days.

(21) Appl. No.: 14/850,487

(22) Filed: Sep. 10, 2015

(51) Int. Cl.

| | |
|---|---|
| ***A63B 69/00*** | (2006.01) |
| ***A63B 69/40*** | (2006.01) |
| ***A63B 69/38*** | (2006.01) |
| ***A63B 71/06*** | (2006.01) |
| *A63B 67/06* | (2006.01) |

(52) U.S. Cl.

CPC ..... *A63B 69/409* (2013.01); *A63B 69/0002* (2013.01); *A63B 69/38* (2013.01); *A63B 71/0622* (2013.01); *A63B 67/06* (2013.01); *A63B 69/00* (2013.01); *A63B 69/0071* (2013.01); *A63B 69/0075* (2013.01); *A63B 69/406* (2013.01); *A63B 2069/0008* (2013.01); *A63B 2069/401* (2013.01); *A63B 2071/0625* (2013.01); *A63B 2210/50* (2013.01); *A63B 2220/30* (2013.01); *A63B 2243/0008* (2013.01)

(58) Field of Classification Search

CPC . A63B 69/0071; A63B 69/409; A63B 69/406; A63B 69/00; A63B 69/40; A63B 69/0075; A63B 69/407; A63B 67/06; A63B 69/0002

USPC ..... 473/431, 436, 475, 422, 451, 462,473/454–456, 438; 124/78, 81, 6, 56, 71, 53.5

See application file for complete search history.

(56) References Cited

U.S. PATENT DOCUMENTS

| | | | | | |
|---|---|---|---|---|---|
| 2,087,575 | A * | 7/1937 | Littell | A63B 69/406 | 473/436 |
| 2,508,461 | A * | 5/1950 | Lemon | A63B 69/409 | 473/431 |
| 2,765,171 | A * | 10/1956 | Cook | A63B 69/409 | 473/431 |
| 3,713,658 | A * | 1/1973 | Cook | A63B 69/406 | 473/436 |
| 3,761,085 | A * | 9/1973 | Cook | A63B 69/406 | 473/436 |
| 3,911,888 | A * | 10/1975 | Horvath | A63B 69/409 | 124/56 |
| 3,989,245 | A * | 11/1976 | Augustine, Jr. | A63B 69/409 | 473/431 |
| 4,002,336 | A * | 1/1977 | Beaver | A63B 69/409 | 473/431 |
| 4,046,131 | A * | 9/1977 | Clark | A63B 47/025 | 124/41.1 |
| 4,116,438 | A * | 9/1978 | Berliner | A63B 69/406 | 473/436 |

(Continued)

FOREIGN PATENT DOCUMENTS

CA 2500606 A1 * 9/2006 ..... A63B 69/3623

*Primary Examiner* — Mitra Aryanpour
(74) *Attorney, Agent, or Firm* — Perkins Coie LLP

(57) ABSTRACT

A ground based launching assembly for feeding balls vertically upwards to a user. The user may takes strokes at fed balls, thereby delivering the balls towards a catching assembly. The catching assembly receives the balls and gently returns the ball back to the launching assembly. Disposed between the catching assembly and the launching assembly is a return ramp and a ball sequencer. These require no more than ten feet in length. Such a device may be readily used in a single car garage or other small room.

15 Claims, 11 Drawing Sheets

(56) References Cited

U.S. PATENT DOCUMENTS 4,185,824 A * 1/1980 Natwick ..... A63F 9/02 124/53.5
RE30,703 E * 8/1981 Paulson ..... A63B 69/406 124/1
4,325,351 A * 4/1982 Yuasa ..... A63B 69/406 124/53.5
4,559,918 A * 12/1985 Ballerin ..... A63B 69/406 124/53.5
4,735,405 A * 4/1988 Marocco ..... A63B 69/409 473/431
4,751,642 A * 6/1988 Silva ..... A63B 69/00 473/438
4,844,458 A * 7/1989 Gatchel ..... A63B 69/406 473/436
4,854,588 A * 8/1989 Gatchel ..... A63B 69/406 473/436
4,915,384 A * 4/1990 Bear ..... A63B 69/0002 473/451
5,009,421 A * 4/1991 Gatchel ..... A63B 69/406 473/436
5,383,658 A * 1/1995 Newgarden, Jr. .... A63B 69/409 473/431
5,566,936 A * 10/1996 Newgarden ..... A63B 69/409 473/431
5,573,239 A * 11/1996 Ryker ..... A63B 63/00 473/436
5,746,670 A * 5/1998 Brady ..... A63B 69/407 473/432
5,882,204 A * 3/1999 Iannazo ..... A63B 69/00 473/438
6,099,417 A * 8/2000 Brown ..... A63B 69/0075 473/417
6,371,872 B1 * 4/2002 Daley ..... A63B 69/406 473/460
6,406,386 B1 * 6/2002 Brazzell ..... A63B 69/406 473/475
6,776,732 B2 8/2004 Parkinson et al.
7,066,845 B2 * 6/2006 Joseph ..... A63B 69/409 473/431
7,156,761 B2 * 1/2007 Mesa ..... A63B 69/409 473/422
7,736,249 B2 * 6/2010 Zhang ..... A63B 69/406 473/459
7,874,942 B2 * 1/2011 Auzoux ..... A63B 69/0075 473/417
8,425,352 B1 4/2013 Loduca et al.
2015/0273311 A1 * 10/2015 Dodds ..... A63B 69/0002 473/421
2016/0136497 A1 * 5/2016 Grou ..... A63B 69/0097 473/434

* cited by examiner

CONTINUOUS BALL FEED AND STROKE PRACTICE DEVICE

TECHNICAL FIELD

Embodiments relate to athletic practice equipment. More particularly, embodiments relate to continuously feeding tennis balls to users.

INCORPORATION BY REFERENCE

U.S. Design patent application Ser. Nos. 29/538,955 and 29/538,950 having the same title and inventors as the present application are hereby incorporated by reference.

BACKGROUND

People enjoy practicing for athletic activities. The nature of sports such as tennis and baseball is such that each requires a lot of space. Prior machines for self-practice include serving machines that pitch balls to users from many yards away across a court, field, or cage. Additionally these machines include large hoppers of balls to compensate for being inanimate and unable to catch balls struck by the user.

BRIEF DESCRIPTION OF THE DRAWINGS

FIGS. 5 and 5A-5C are a cross-sectional view of an alternate embodiment of a sequencing assembly;

DETAILED DESCRIPTION

Embodiments include a machine with a ground based launching assembly for feeding a ball vertically to a user or player. Once the ball is launched, a player is able to strike the ball and deliver the ball towards a catching assembly. The catching assembly receives the ball and returns the ball back to the launching assembly. Disposed between the catching assembly and the launching assembly is a return ramp and a ball sequencer. All of these components require no more than ten feet in length. Width of the play area depends on arm wingspan, and swing stance of the player. Such a device may readily be used in a single car garage or other small room.

Figure 1:
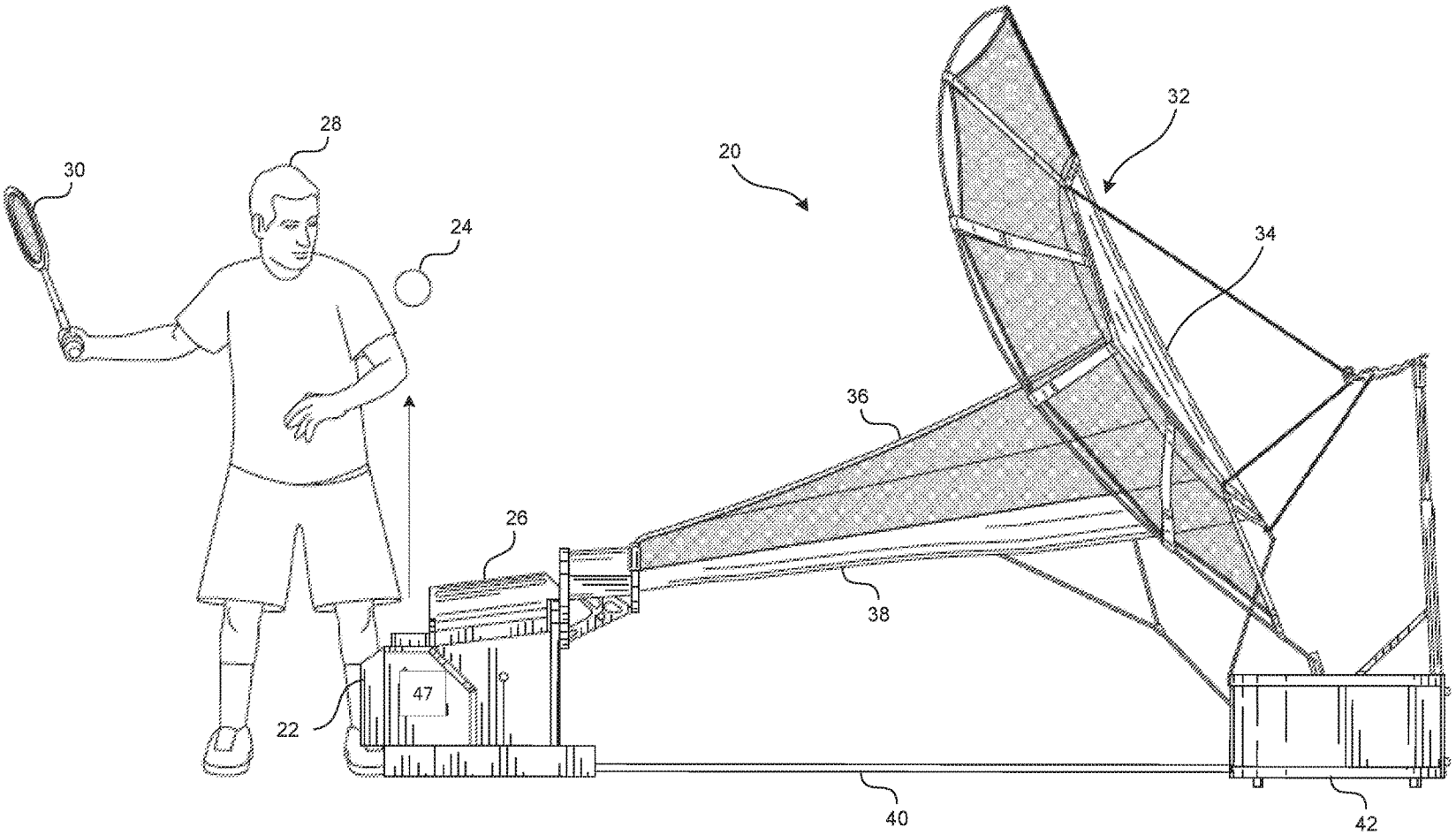
FIG. 1 is a perspective view a continuous ball feeding and catching apparatus, according to various embodiments.
Figure 9:
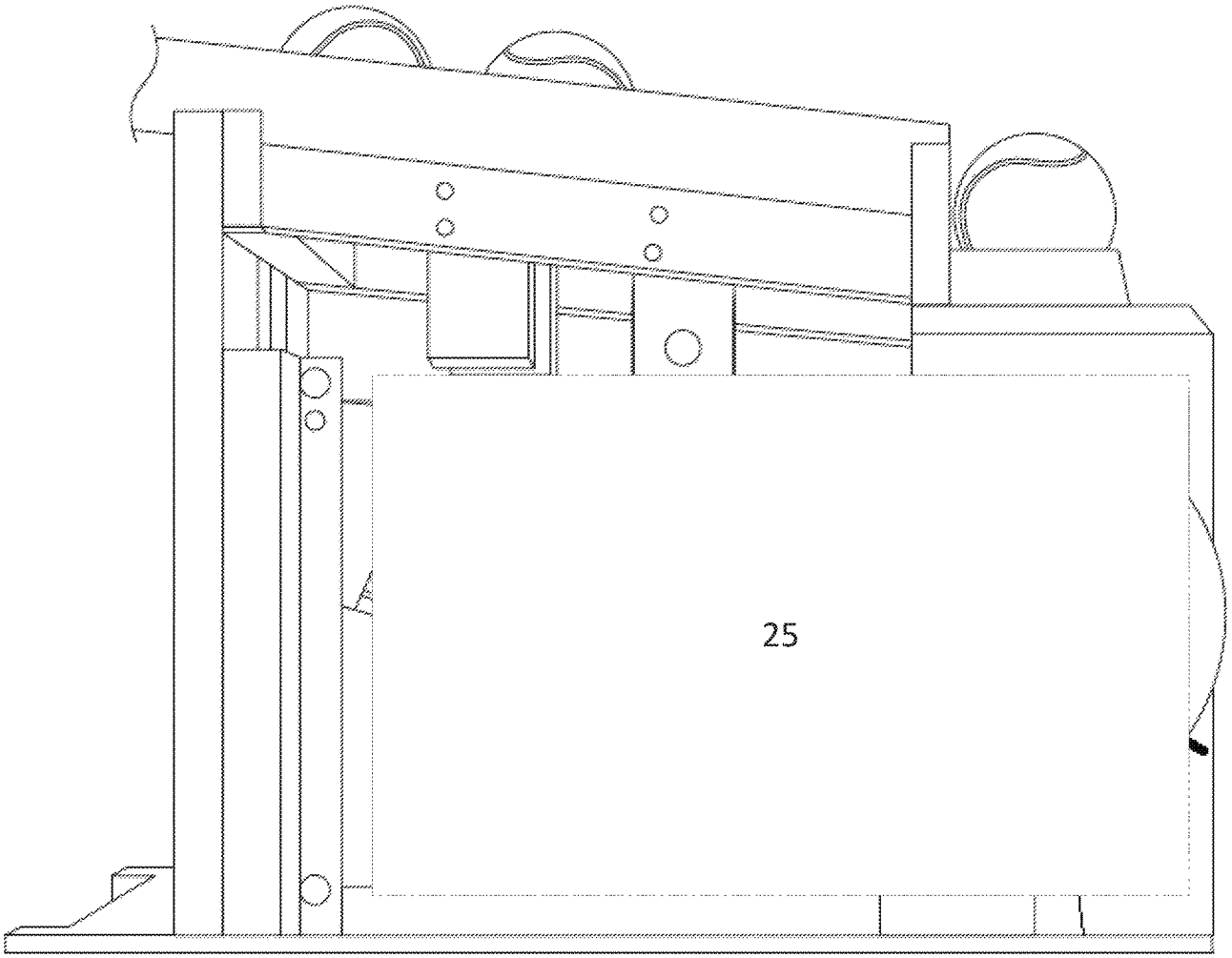
FIG. 9 is a cross-sectional view of a launching assembly including a pneumatic hammer, according to various embodiments.
Figure 10:
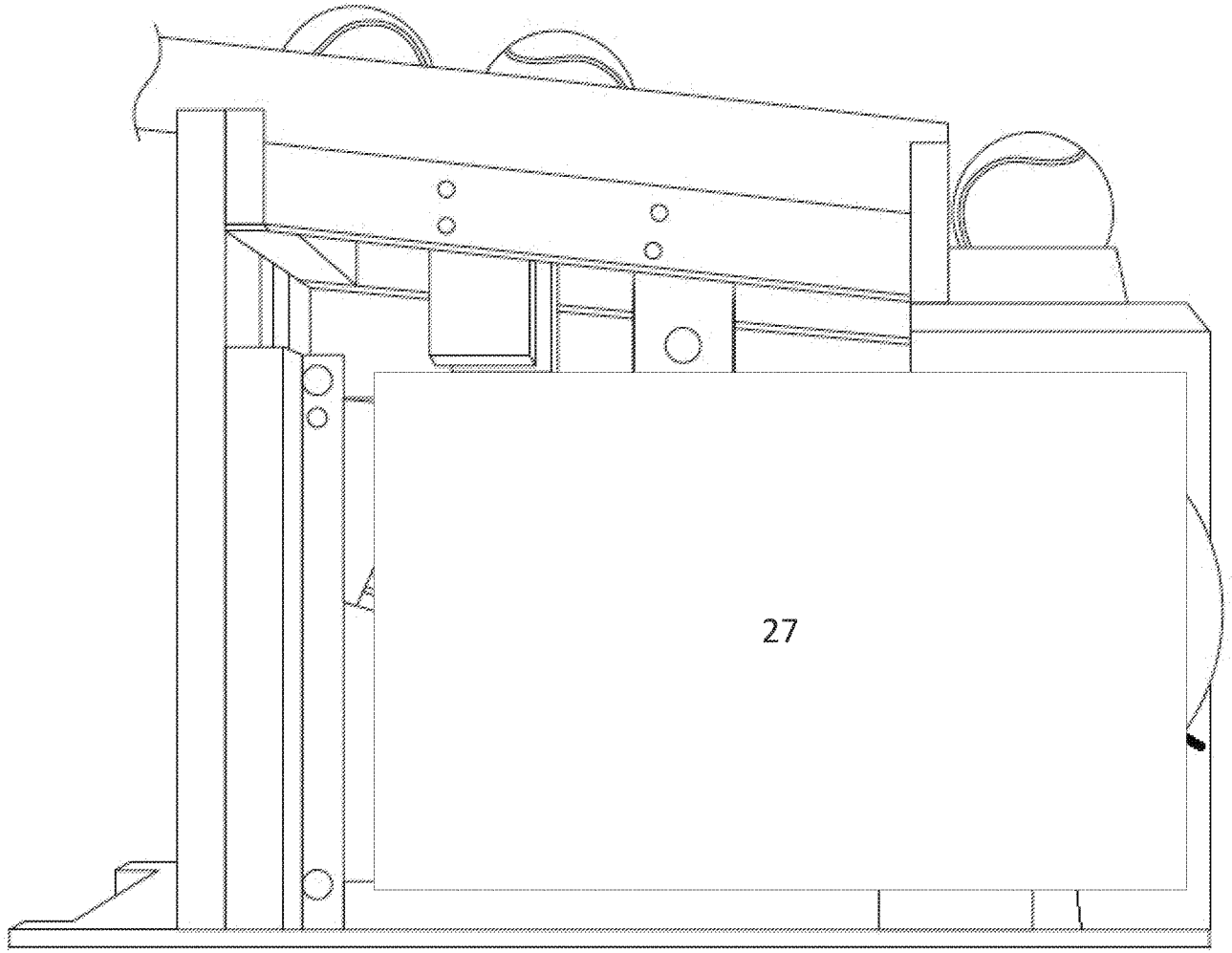
FIG. 10 is a cross-sectional view of a launching assembly including one or more gas jets, according to various embodiments.

FIG. 1 is a perspective view a continuous ball feeding and return apparatus 20, according to various embodiments. The continuous feed and return apparatus 20 includes a ball launching assembly 22 which provides predetermined, vertical force at a regular time interval to a ball 24. The launching assembly 22 is placed on the ground and balls 24 are launched upwards. The means for applying force to a ball 24 can vary. Examples include the use of a motorized or pneumatic hammer 25 (see FIG. 9). Other embodiments make use of high pressure air/gas jets 27 (see FIG. 10) or accelerating wheels. Embodiments of the launching assembly 22 further include an interval selection mechanism for adjusting the rate upon which the launching assembly launches balls. This mechanism varies in shape and character depending on what means apply force to the ball 24. Embodiments include a slider or a dial which provides speed tuning for the means for applying force.

The ball launching assembly launches balls of any kind, though any given embodiment of the launching assembly is only configured for balls in a relatively narrow diameter range (e.g. an embodiment that launches tennis balls would not also launch basketballs). The apparatus 20 works most readily with balls that are intended to be struck mid-air such as tennis balls, baseballs, softballs, racquetballs, lacrosse balls, etc.

The apparatus 20 further includes a sequencing mechanism 26 positioned adjacent to the ball launching assembly 22. The sequencing mechanism 26 feeds balls 24, one at a time, to the ball launching assembly 22. It is important that multiple balls are not fed to the launcher 22 at the same time, as this can cause jams. Further, some balls, such as tennis balls, have a tendency to stick to one another, thus sequencing resolves issues caused by this tendency. Sequencing means include the use of gates, the use of a selection/grabbing mechanism, or a cycling opening. Gravity is often utilized in each of these means.

Once launched, if untouched, the balls 24 will reach an apex height, then fall to the ground. Should the balls 24 remain untouched for enough cycles, the apparatus 20 will exhaust the supply of balls 24 and cease to continue launching. However, the intent is that a user or player 28 strike the balls 24 such as with a racket 30 or bat. Alternatively, the player 28 may catch and throw the balls with either their hands or some other sporting apparatus. Embodiments of the launching assembly 22 include an adjustment mechanism (not shown) for increasing or decreasing the force applied to the ball thereby adjusting the apex height.

The apparatus 20 further includes a catching assembly 32. The catching assembly receives the balls 24 once the player strikes/throws the balls. Multiple embodiments of a catching assembly 32 exist. The important details for a catching assembly 32 are that balls 24 propelled by the player 28 having a substantially horizontal flight arc towards a selected area are caught and funneled to a predetermined location, often by gravity. In some embodiments, the player 28 may readily disassemble and stow the catching assembly 32 (tool-less). While shape varies between embodiments, the catching assembly 32 includes a substantially concave shaped backstop 34 and side netting 36. As is observable in FIG. 1, some embodiments of the backstop 34 are constructed in a parabolic hyperboloid shape.

The apparatus 20 includes a return ramp 38 disposed between the catching assembly 32 and the sequencing mechanism 26. The return ramp 38 directs balls caught by the catching assembly back to the sequencing mechanism thereby completing the cycle loop. Accordingly, relatively few balls are required to keep the apparatus in constant operation with the participation of the player. The return ramp includes a means for rigidity such that the ramp remains taught between the sequencing mechanism 26 and the catching assembly 32 and balls 24 do not get caught on the ramp 38. Displayed in FIG. 1, a tension bar 40 positioned between the launching assembly 22 and the storage base unit 42 keeps the return ramp 38 taught. Further, some embodiments of the return ramp 38 are configured for tool-less disassembly.

In some embodiments, the racket 30 is attached to the launching assembly 22 by rope or cable (not shown). This enables the apparatus 20 to be set up in an arcade or public area and reduces the likelihood a malcontent walks away with the racket 30.

Figure 2:
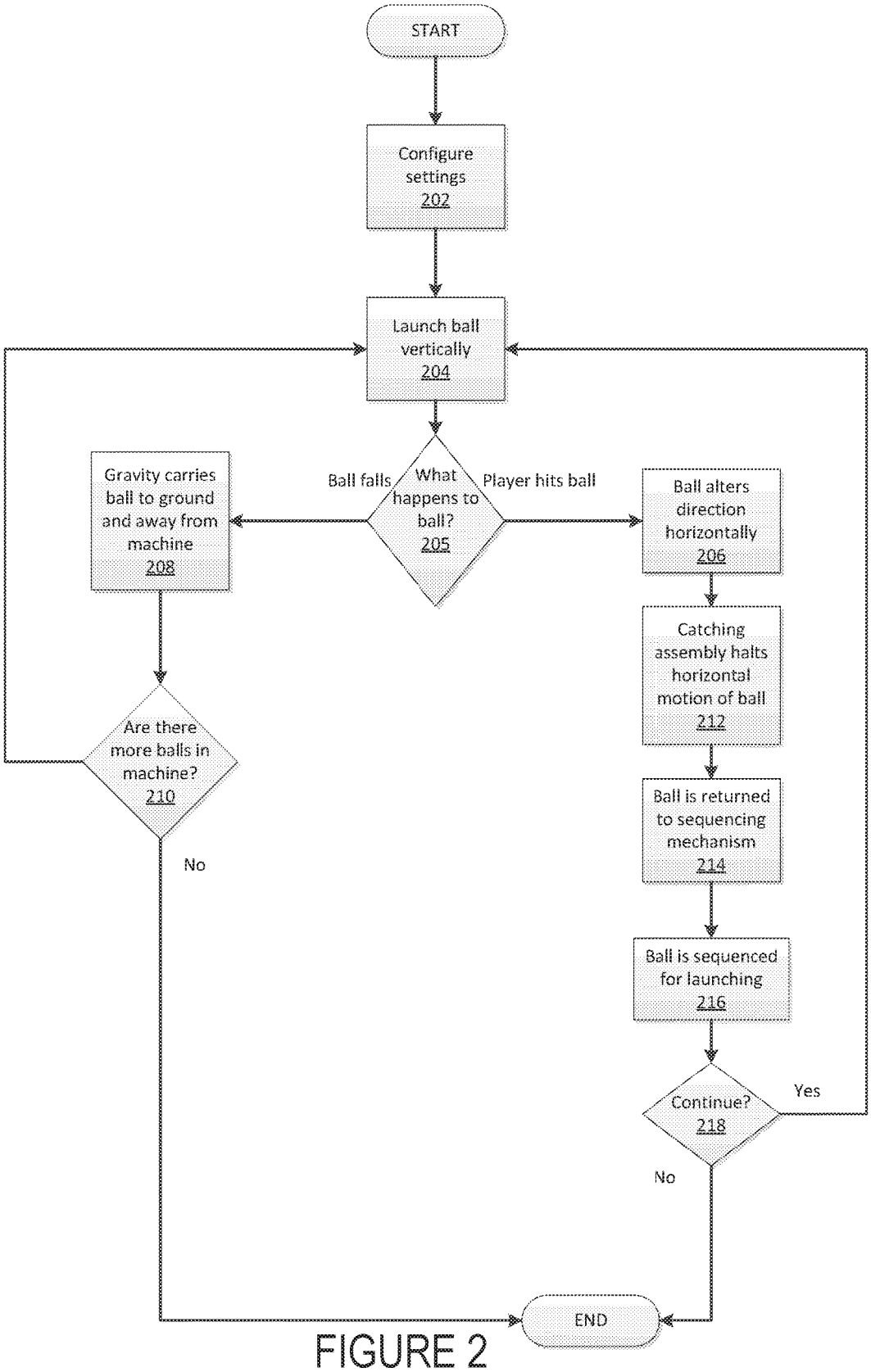
FIG. 2 is a flow chart of a method for operating a continuous ball feeding and catching apparatus.

FIG. 2 is a flow chart of a method for operating a continuous ball feeding and catching apparatus. In step 202, a player checks the settings for the launching assembly such that the launch interval and launch apex are at preferred settings. In step 204, the launching assembly launches a ball vertically upward from a ground. The ball reaches a predetermined apex height above the ground based launcher. Step 205 is determined by player action or non-action.

In step 206, the ball receives horizontal force from a player thereby altering the direction of the ball towards the catching assembly. Alternatively, if the player does not strike the ball, in step 208, the ball reaches its flight apex and falls to the ground. In step 210, if more balls are present in the sequencing mechanism, and by extension the launching assembly, additional balls are launched. Otherwise, the process ends.

In step 212, the catching assembly halts the horizontal progress of the ball and directs the ball towards the return ramp. In step 214, the ball is returned to the sequencing mechanism in a controlled manner. In step 216, the sequencing mechanism feeds balls, one at a time, to the launching assembly. In step 218, this process continues until the apparatus is shut off.

Figure 3:
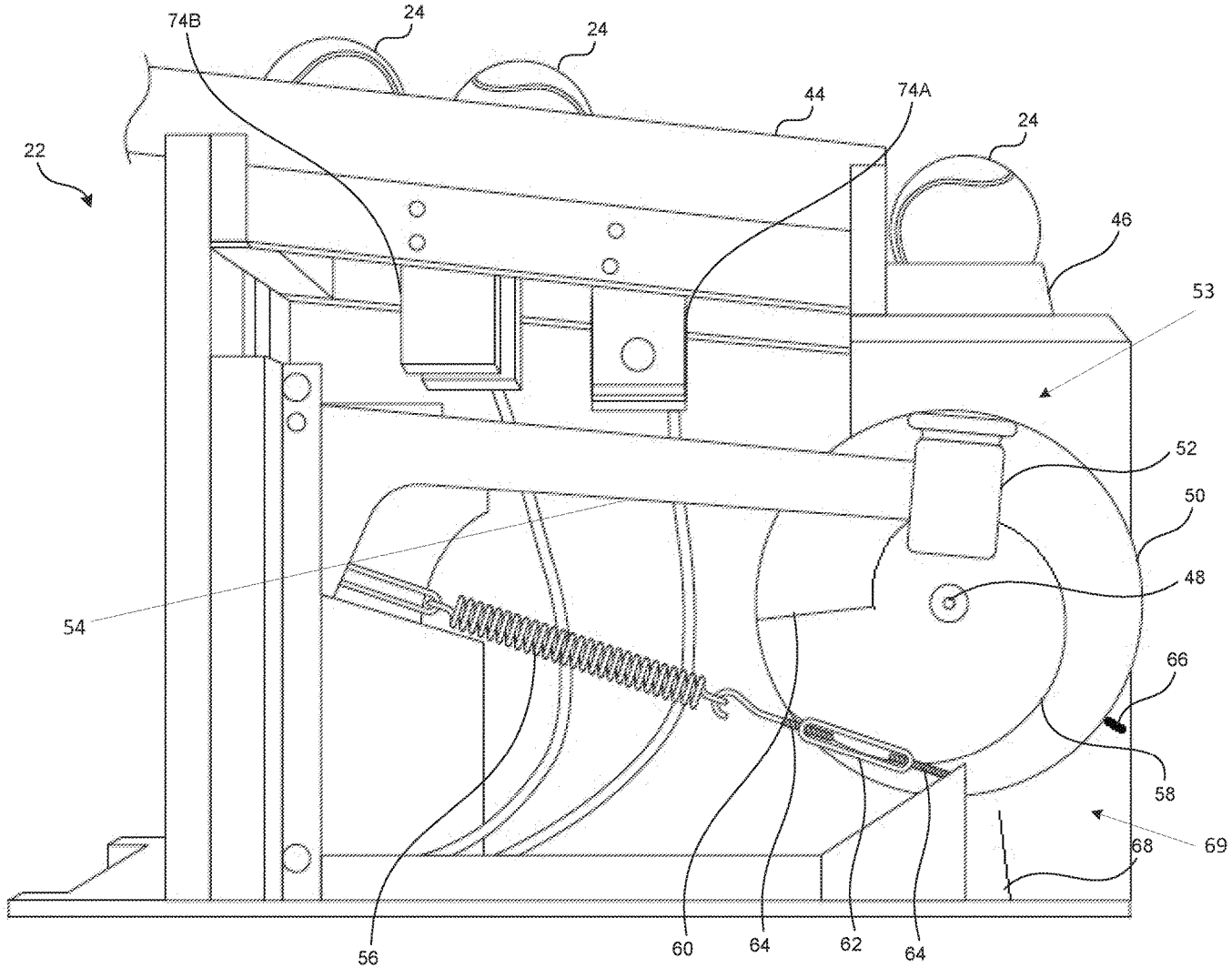
FIG. 3 is a cross-sectional view of a launching assembly, according to various embodiments.

FIG. 3 is a cross-sectional view of a launching assembly 22, according to various embodiments. The depicted embodiment makes use of a spring loaded hammer to strike balls 24. Across the top of the first embodiment is a feed channel 44 for delivering balls to a launch platform 46. The feed channel 44 works with the sequencing mechanism 26 to deliver the balls 24. In embodiments other than that depicted in FIG. 3, the feed channel 44 and sequencing mechanism 26 may differ in appearance and form, but provide the same function.

In the displayed embodiment, a single electric motor 47 (see FIG. 1) turns an axle 48 which rotates a guide wheel 50 which guides a hammer 52. A hammer 52 driven by a motorized axle 48 is a motorized hammer 53. The hammer 52 is affixed to a lever 54 positioned by a spring 56. The guide wheel 50 displayed includes a spiraled groove 58. The spiraled groove 58 draws back and releases the spring loaded hammer 52 to strike a ball 24 on the launch platform 46 as the guide wheel 50 is rotated by the electric motor. The natural tendency of the hammer 52 is to remain in the striking position as a result of the spring 56. The hammer 52 includes a peg or a guide (not shown) which is received by the spiraled grove 58. When the guide wheel 50 rotates such that the release groove 60 is at the top of the guide wheel 50, the peg/guide of the hammer 52 is freed and the hammer 52 springs upwards.

The spring 56 includes an adjustment mechanism 62. Depicted here, the adjustment mechanism 62 is a threaded loop. Turning the threaded loop 62 on adjacent screws 64 stretches or relaxes the spring 56 thereby causing more or less force to apply to the hammer 52. In other embodiments, the adjustment mechanism 62 takes other forms. For example where compressed air propels the ball or a hammer, a valve adjusts the amount of force provided. In some embodiments, the adjustment mechanism 62 includes an apparatus exterior control for ease of use. This control comprises a dial, a knob, a lever, a locking rod the user pulls on and locks at varying levels of extension, or other control means known in the art.

Affixed to the guide wheel 50 is an indicator peg 66. As the guide wheel 50 rotates, shortly before the release groove 60 reaches the top of the rotation, the indicator peg 66 clips a resistance card 68 which generates a sound. The sound indicates to the player 28 that the ball 24 is about to be launched. The indicator peg 66 and resistance card 68 may be described as a "noisemaker" 69. The same result is achievable through use of a speaker or placing the indicator peg 66 on any other timed component of the apparatus 20. Adjusting the extension of the spring associated with the spring loaded hammer adjusts the apex height of the launched balls. Adjusting the speed of the electric motor changes the interval of ball launch.

Other types of launching mechanism are additionally included in preferred embodiments. The spring loaded hammer is an illustrative example. In other embodiments, a pneumatic hammer may perform the same function. Alternatively, an air compressor and a set of valves beneath the launch platform 46 provide sufficient force to launch the ball from the launch platform to an apex height.

Figure 4:
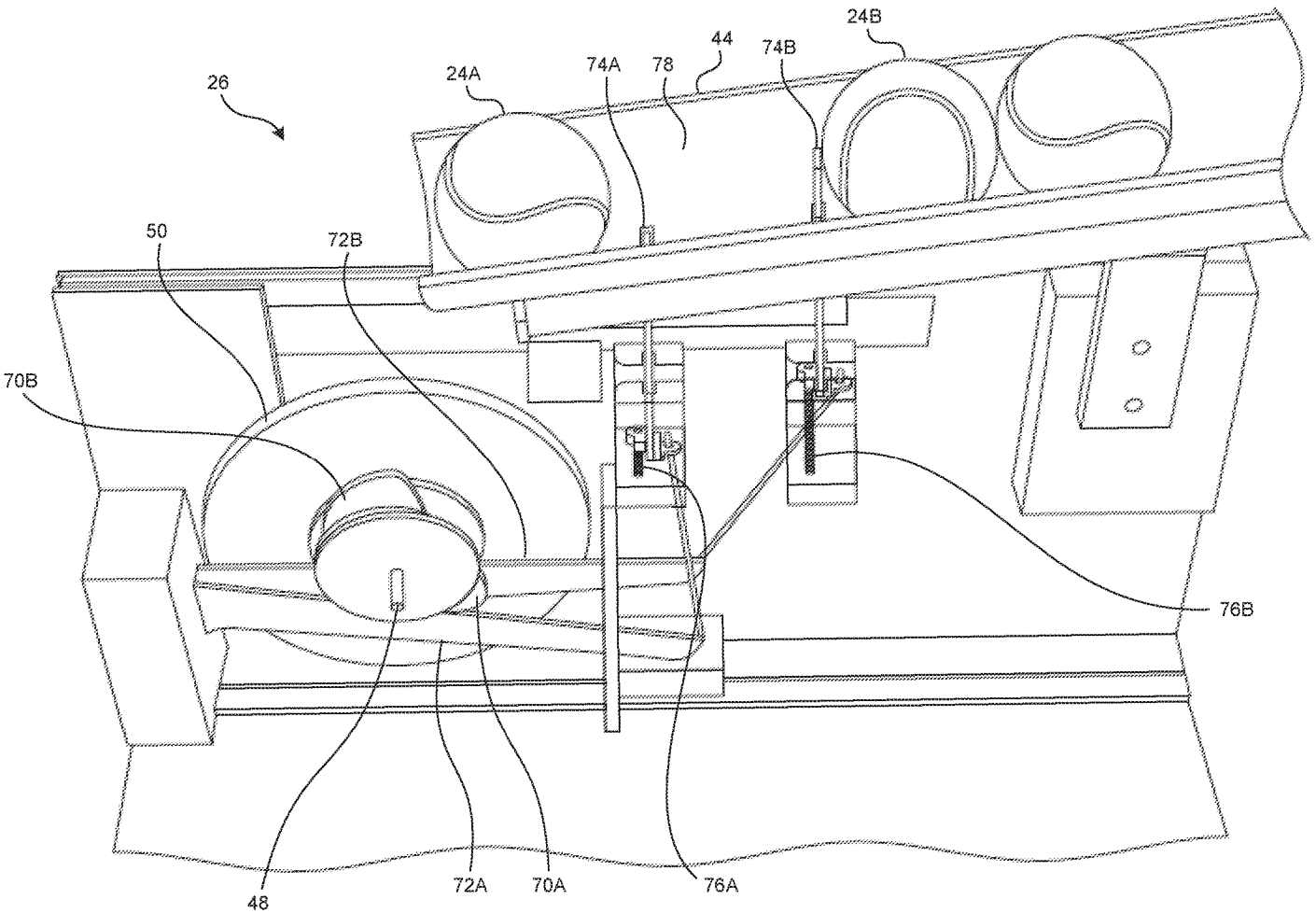
FIG. 4 is a cross-sectional view of a first embodiment of a sequencing assembly.

FIG. 4 is a cross-sectional view of a first embodiment of a sequencing assembly 26. On the reverse side of the guide wheel 50 are cams 70*a*, 70*b*. The cams 70*a*, 70*b* guide direct levers 72*a*, 72*b* to lower gates 74*a*, 74*b* at opposing times. Depending on the configuration of gate springs 76*a*, 76*b*, either releasing pressure or applying pressure to the levers 72*a*, 72*b* draws open the gates 74*a*, 74*b*. As displayed in FIG. 4, applying pressure with the cam 70*a* to lower the lever 72*a* the lever lowers the gate 74*a* and enables a single ball 24*a* to roll down the feed channel 44 to the launching platform 46. When the gates 74*a*, 74*b* alternate, the next ball 24*b* will roll into the staging area 78.

The design displayed in FIGS. 3 and 4 is configured for compactness. The size can be further reduced from the displayed embodiment by adjusting the angle of the components, the size of the springs and the thickness of the electric motor. The size of the feed channel 44 is dictated by the size of the balls 24 sequenced and launched.

Figure 5:
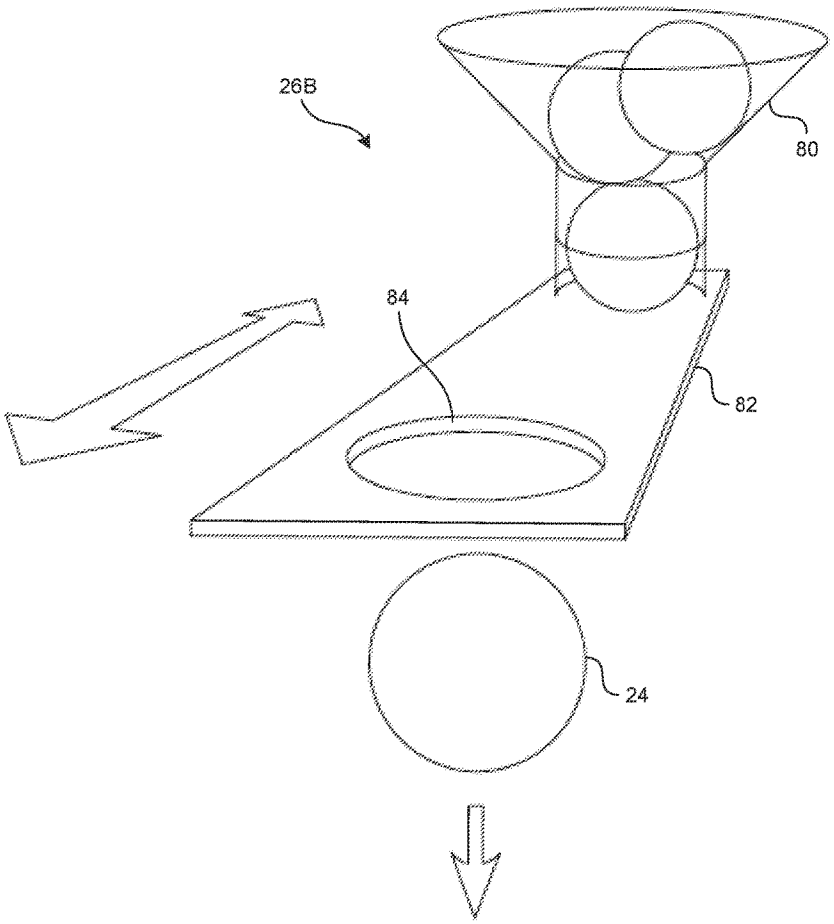
Figure 5:
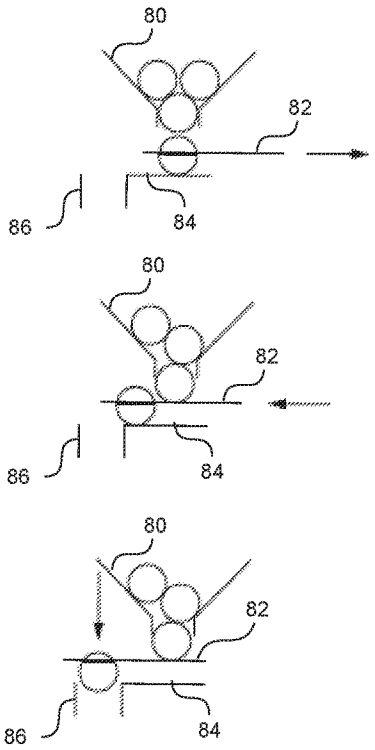

FIG. 5 is a cross-sectional view of a second embodiment of a sequencing assembly 26B. In the displayed alternate embodiment, rather than using a feed channel 44 and alternating gates 74*a*, 74*b*, a feed hopper 80 and sliding collection plate 82 is used. Balls delivered by the return ramp 38 are deposited in the feed hopper 80. At the base of the feed hopper 80 is a sliding collection plate 82. The sliding collection plate 82 contains a hole 84 sized to fit the diameter of one ball 24. The sliding collection plate 82 moves laterally across a shelf 85.

When the hole 84 is positioned under the feed hopper 80, a ball 24 falls from the feed hopper 80 in the hole 84 in the sliding collection plate 82. The sliding collection plate 82 then moves across the shelf 85 with the ball 24 and deposits the ball 24 in a chute 86. The chute 86 delivers the ball to the launch platform 46.

Figure 6:
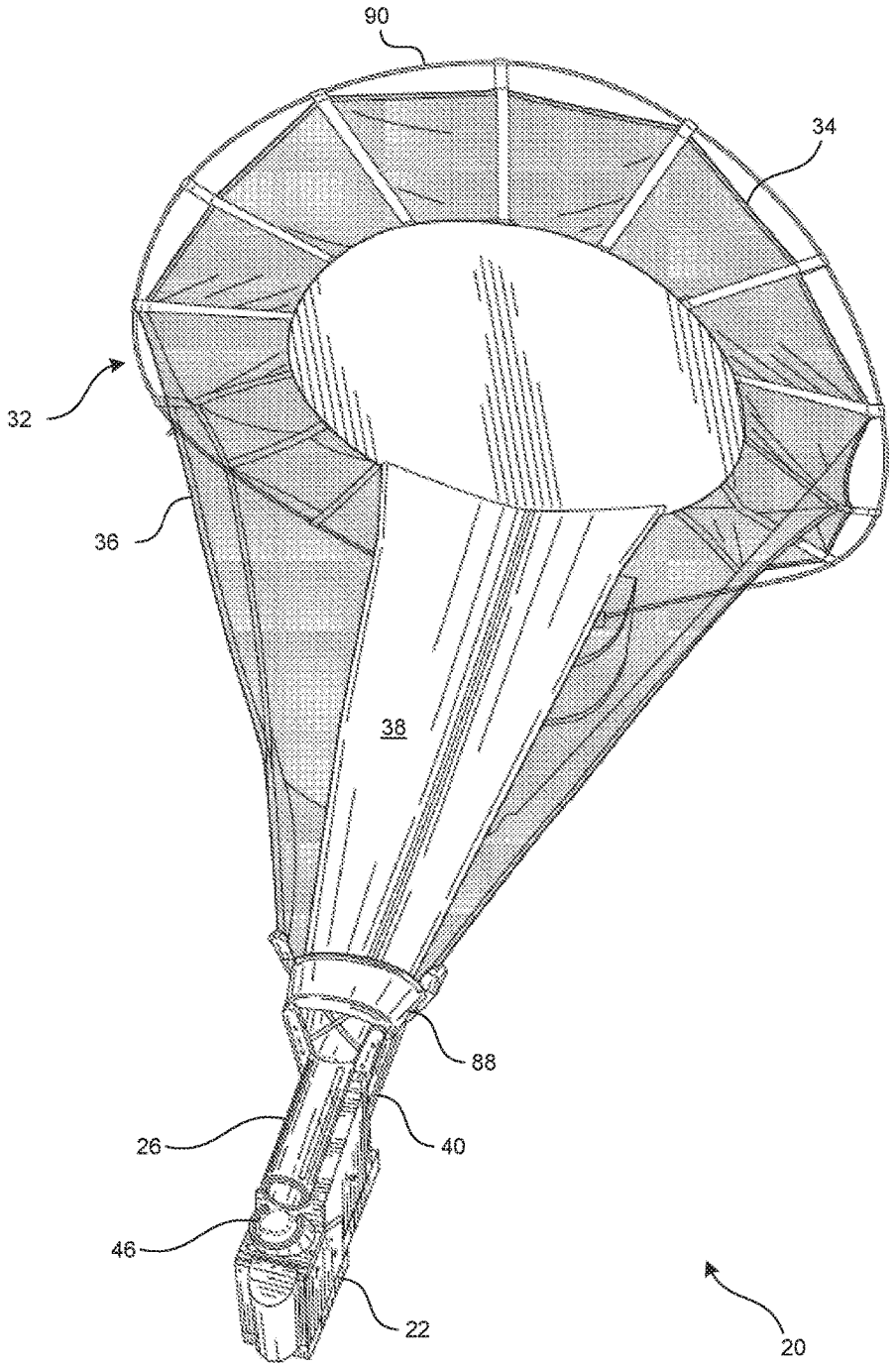
FIG. 6 is a perspective view of a first embodiment of a catching assembly and return ramp.

FIG. 6 is a perspective view of a first embodiment of a catching assembly 32 and return ramp 38. The embodiment of the catching assembly 32 displayed includes a backstop 34 which is substantially a parabolic paraboloid. This shape is sometimes likened to that of a "Pringle" chip. The backstop 34 is positioned at an angle such that were a ball 24 to strike any point on the backstop 34, the ball 24 is redirected downward and towards the return ramp 38.

Additionally, side nets 36 are strung up on either side of the backstop 34 and return ramp 38 to provide greater control in catching incoming balls 24. The return ramp 38 includes a rigging 88 to attach to the sequencing mechanism. The rigging 88 detaches from the sequencing mechanism 24 without the use of tools for easy disassembly and storage.

The backstop 34 is constructed of flexible and durable material. Examples includes nylon, polyvinyl, urethane, vinyl, hypalon, or nitrylon. The backstop 34 is supported by a bendable hoop 90 affixed to a storage base unit 42. The store base unit 42 further includes a support structure configured to keep the back stop and side netting taught (see FIG. 1). The return ramp 38 remains taught as a result of a tension bar 40 positioned between the launcher/sequencer 22/26 and the storage base unit 42 of the catching assembly 32.

In some embodiments the backstop 34 includes a contact sensitive layer. The contact sensitive layer detects where the ball strikes on the backstop 34. This data is then provided either wirelessly by a network transceiver, or wired using cable configurations commonly known in the art to a processor operated device. The processor operated device can be programmed to analyze and report the data.

Figure 11:
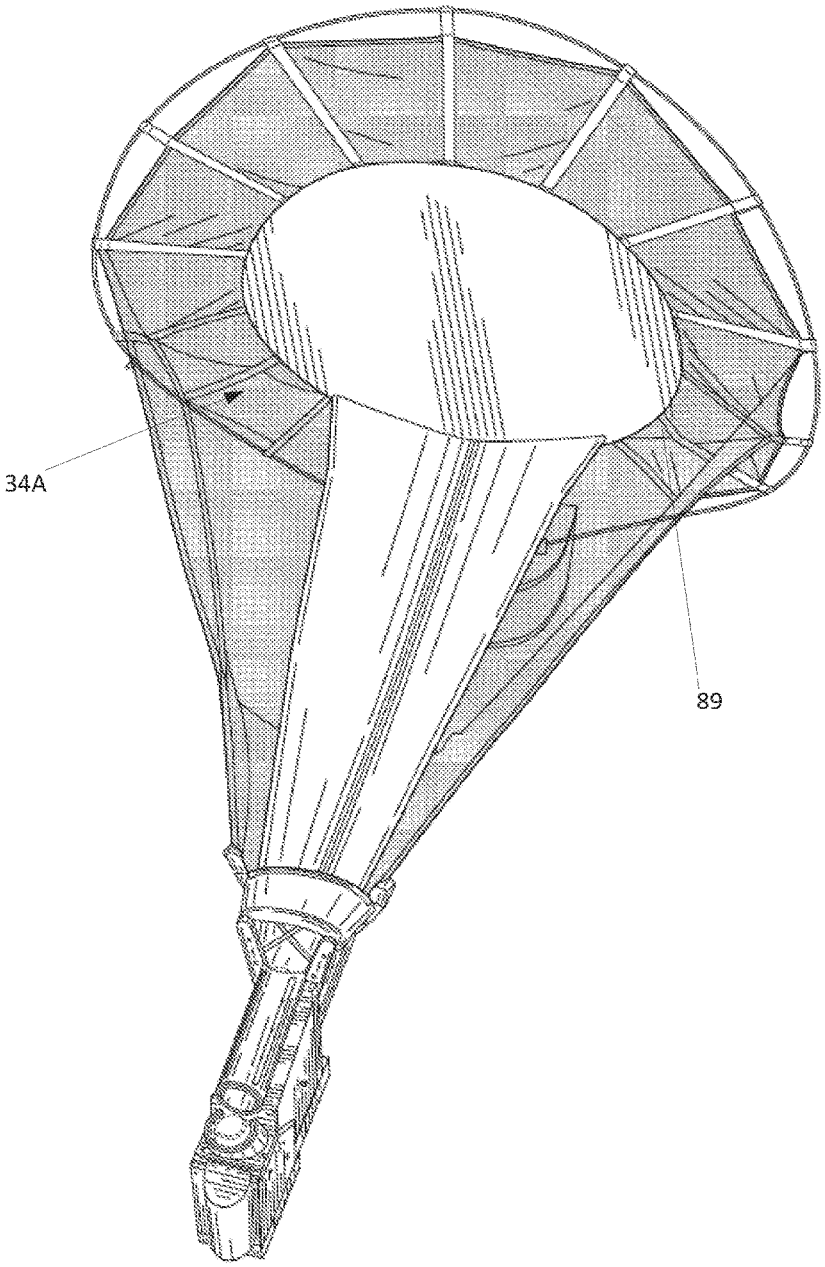
FIG. 11 is a perspective view of a contact sensitive backstop with a display screen.

The backstop 34 may further include a display screen 89 (see FIG. 11). Examples of the sort of thing displayed on the screen include targets or the opposing side of a tennis court. In combination with the contact sensitive layer, the display screen 89 reacts to contacts of the ball 24 to certain locations on a contact sensitive backstop 34A. In use, a player 28 is encouraged to hit targets displayed on the display screen with balls 24. In another portion of the display screen a player score is displayed. Images on the display screen are directed by the processor operated device. The processor operated device includes a graphics card to aid in the presentation and alteration of images. As is observable in FIG. 6, some embodiments of the backstop 34 are a parabolic hyperboloid.

Figure 7:
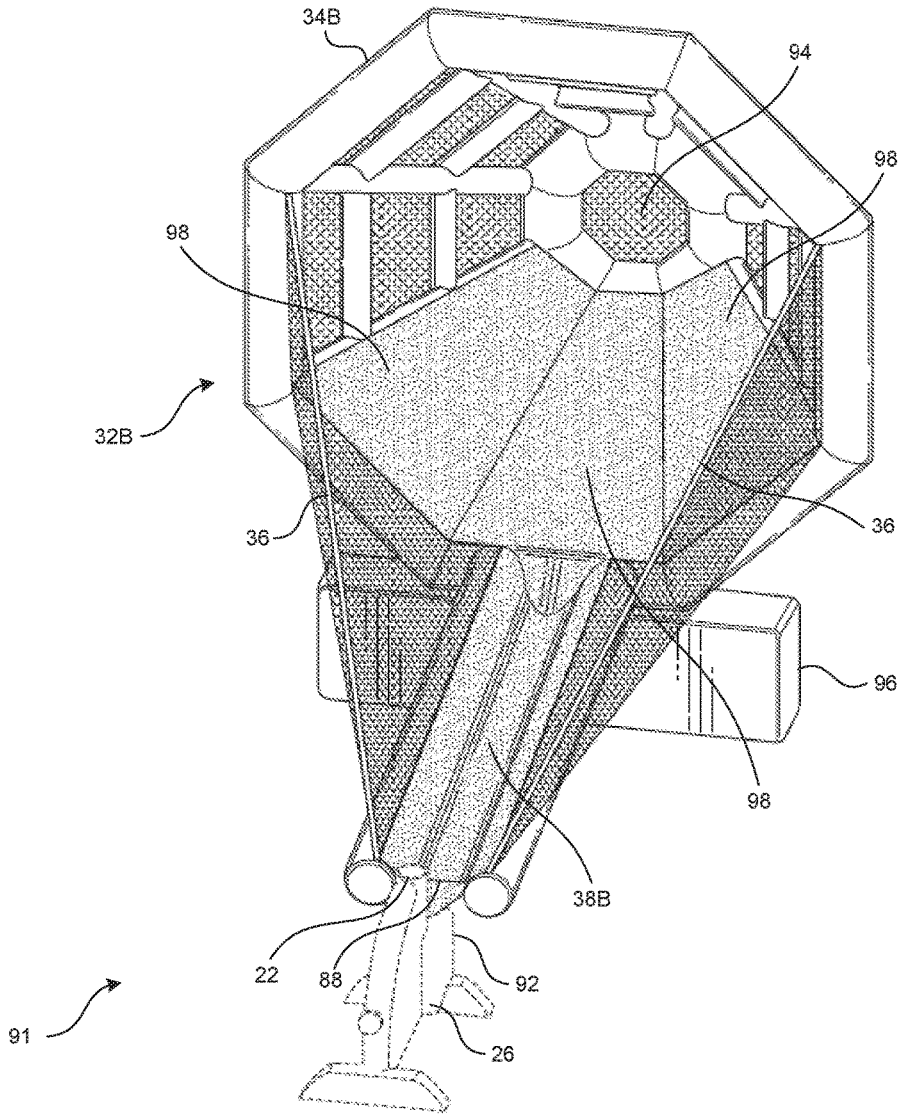
FIG. 7 is a perspective view of a second embodiment of a catching assembly and return ramp.

FIG. 7 is a perspective view of a second embodiment 91 of a catching assembly 32B and return ramp 38B. The displayed embodiments of the catching assembly 32B and return ramp 38B are inflatable. The ridged structure is maintained through air pressure. An air pump 92 inflates the catching assembly 32B and return ramp 38B. In some embodiments, the air pump 92 is affixed to the launching assembly 22 and sequencing mechanism 26. Alternatively, the air pump 92 is contained in a separate base unit (not shown) associated with storage of deflated apparatus.

The second embodiment 91 includes a plurality of netting 94 strung between inflatable structural elements. The return ramp 38B affixes to the sequencing mechanism 26 with a rigging 88. Side nets 36 extend from a catching assembly backstop 34B to the return ramp rigging 88 for improved control of stray balls 24. The inflatable catching assembly 32B and return ramp 38B are supported by an inflatable base 96. Example materials for the inflatable catching apparatus and return ramp include flexible and durable material such as nylon, polyvinyl, urethane, vinyl, hypalon, or nitrylon.

The inflatable backstop 34B includes flexible panels 98 to reduce friction between the catching assembly 32B and the ball 24. The flexible panels 98 stretch taught within the backstop 34B and fold for storage when the backstop 34B is not inflated.

Figure 8:
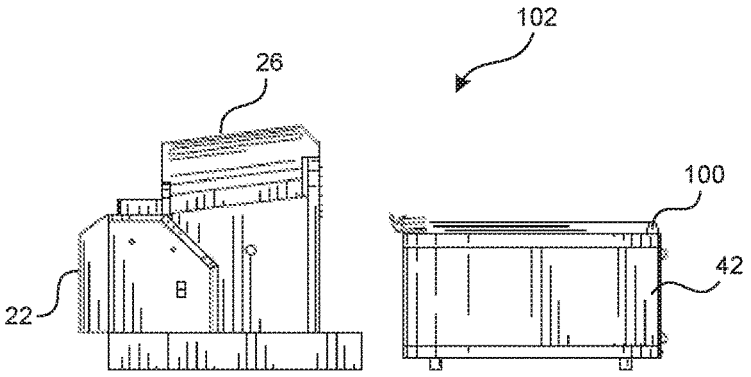
FIG. 8 is a side view of a stowed configuration of a continuous ball feeding and catching apparatus, according to various embodiments.

FIG. 8 is a side view of a stowed configuration of a continuous ball feeding and catching apparatus, according to various embodiments. The catching assembly 32 and the return ramp 38 have been folded up, the bendable hoop 90 disassembled, the backstop rigging 100 telescoped to a smaller form and folded atop the storage base unit 42. The tension bar 40 has also been broken down into pieces. All of these components are placed inside the hollow volume of the storage base unit 42. The resulting apparatus 102 is compact and easy to store.

The invention claimed is:

1. A vertical ball serving and return apparatus, comprising:

a ball launching assembly which provides predetermined, vertical force at a regular time interval to a ball;

a sequencing mechanism positioned adjacent to said ball launching assembly for feeding balls, one at a time, to the ball launching assembly, wherein the sequencing mechanism includes:

a feed hopper configured to receive said balls and including an aperture at the base of the feed hopper, the aperture sized for the passage of one of said balls at a time;

a sliding collection plate disposed below the feed hopper and configured to move laterally across a shelf and collect a single ball from the feed hopper when moving laterally across the shelf and deposit the single ball at an opposing end of the shelf; and a feed path disposed at the opposing end of the shelf from the feed hopper and sized for the passage of one of said balls and configured to direct the single ball to the ball launching assembly;

a catching assembly, configured to collect said balls having a substantially horizontal flight arc and the catching assembly positioned remote from the ball launching assembly; and a return ramp disposed between the catching assembly and the sequencing mechanism and configured to receive said balls collected by the catching assembly and deliver said balls to the sequencing mechanism.

2. The vertical ball serving and return apparatus of claim 1, wherein the ball launching assembly is configured to launch any of: tennis balls; baseballs; and softballs.

3. The vertical ball serving and return apparatus of claim 1, the ball launching assembly further comprising:

a pneumatic hammer configured to strike vertically and impart vertical force to the balls.

4. The vertical ball serving and return apparatus of claim 1, the ball launching assembly further comprising:

a motorized hammer configured to strike vertically and impart vertical force to the balls.

5. The vertical ball serving and return apparatus of claim 1, the ball launching assembly further comprising:

one or more gas jets configured to expel high pressure gas in a substantially vertical direction and impart vertical force to the ball.

6. The vertical ball serving and return apparatus of claim 1, the ball launching assembly further comprising:

an adjustment mechanism for increasing or decreasing the vertical force provided to the ball, thereby adjusting an apex height the ball reaches after launched.

7. The vertical ball serving and return apparatus of claim 1, the catching assembly further comprising:

a backstop having a substantially hyperbolic paraboloid shape.

8. The vertical ball serving and return apparatus of claim 1, the catching assembly further comprising:

an inflatable backstop; and an air pump coupled with at least the inflatable backstop and configured to inflate the inflatable backstop.

9. The vertical ball serving and return apparatus of claim 8, the return ramp further comprising:

an inflatable ramp coupled to the air pump and configured to share enclosed air held by the inflatable backstop.

10. The vertical ball serving and return apparatus of claim 1, the catching assembly further comprising:

a contact sensitive backstop configured to display an image, the contact sensitive backstop configured to detect both location and velocity of impacts of said balls against the backstop.

11. The vertical ball serving and return apparatus of claim 1, the ball launching apparatus further comprising:

a noisemaker configured to emit a delivery noise a predetermined period of time before providing the predetermined, vertical force to the ball.

12. The vertical ball serving and return apparatus of claim 8, wherein the inflatable backstop is comprised of any of: polyvinyl; urethane; vinyl; nylon; hypalon; or nitrylon.

13. The vertical ball serving and return apparatus of claim 1, wherein the catching assembly and the return ramp are configured for assembly and disassembly without tools.

14. The vertical ball serving and return apparatus of claim 13, further comprising:

a storage compartment configured to store the catching assembly and return ramp when disassembled.

15. The vertical ball serving and return apparatus of claim 1, wherein the apparatus is configured for use in a rectangular area, the rectangular area having a major length dimension of no greater than ten feet.

* * * * *